US010428612B2

(12) United States Patent
Wade

(10) Patent No.: US 10,428,612 B2
(45) Date of Patent: Oct. 1, 2019

(54) APPARATUS AND METHOD FOR WITHDRAWING CORES FROM DRILLED HOLES

(71) Applicant: Byron Harvey Wade, Auburn, KY (US)

(72) Inventor: Byron Harvey Wade, Auburn, KY (US)

( * ) Notice: Subject to any disclaimer, the term of this patent is extended or adjusted under 35 U.S.C. 154(b) by 333 days.

(21) Appl. No.: 15/440,403

(22) Filed: Feb. 23, 2017

(65) Prior Publication Data

US 2017/0292340 A1 Oct. 12, 2017

Related U.S. Application Data

(60) Provisional application No. 62/319,188, filed on Apr. 6, 2016.

(51) Int. Cl.
*E21B 25/12* (2006.01)
*E21B 25/02* (2006.01)

(52) U.S. Cl.
CPC ..... *E21B 25/12* (2013.01); *E21B 25/02* (2013.01)

(58) Field of Classification Search
CPC ..... E21B 25/12; E21B 25/10; E21B 25/02
See application file for complete search history.

(56) References Cited

U.S. PATENT DOCUMENTS 366,914 A * 7/1887 Ball ..... E21B 25/10 175/253
2,090,304 A * 8/1937 Newsom ..... E21B 4/04 175/104
2,140,645 A * 12/1938 Miller ..... E21B 25/10 175/255
2,205,598 A * 6/1940 Miller ..... E21B 25/12 175/251
2,499,543 A * 3/1950 Townsend ..... E21B 25/12 175/255
3,279,740 A * 10/1966 Long ..... B28B 7/30 249/151
3,279,741 A * 10/1966 Long ..... B28B 7/30 249/151
3,340,939 A * 9/1967 Lindelof ..... E21B 25/02 175/246
7,934,568 B2 * 5/2011 Myrick ..... E21B 25/12 175/20

(Continued)

*Primary Examiner* — Nicole Coy
(74) *Attorney, Agent, or Firm* — Dunlap Bennett & Ludwig PLLC

(57) ABSTRACT

A core extracting apparatus and method is provided. The annular core extracting apparatus may be dimensioned so as to be lowered into the core groove circumscribing a drilled core. The core extracting apparatus has a cylindrical outer casing encasing a cylindrical inner grabber in a release condition, wherein the inner grabber is adapted to move from the release condition to a gripping condition as the outer casing is lifted from the core groove. The inner grabber provides a plurality of peripheral fingers, each finger providing a wedge along its outer surface, wherein the release condition each wedge nests in a taper provided by the outer casing so that when the inner grabber moves to the gripping condition the wedge interfaces with the outer casing to urge the fingers inward, gripping the core and extracting it from the drilling hole.

8 Claims, 4 Drawing Sheets

(56) References Cited

U.S. PATENT DOCUMENTS

| | | | | |
|---|---|---|---|---|
| 8,770,320 | B2 * | 7/2014 | Drenth | E21B 25/12 175/244 |
| 2014/0318206 | A1 * | 10/2014 | Drenth | E21B 25/12 72/379.2 |
| 2015/0247369 | A1 * | 9/2015 | Beach | E21B 25/16 175/251 |
| 2017/0284160 | A1 * | 10/2017 | Drenth | E21B 25/12 |

* cited by examiner

APPARATUS AND METHOD FOR WITHDRAWING CORES FROM DRILLED HOLES

CROSS-REFERENCE TO RELATED APPLICATION

This application claims the benefit of priority of U.S. provisional application number 62/319,188, filed 6 Apr. 2016, the contents of which are herein incorporated by reference.

BACKGROUND OF THE INVENTION

The present invention relates to core drilling and, more particularly, to an apparatus for extracting cores from drilled holes.

Rotary core drilling involves drilling holes coring the earth using an annular drill bit or head attached to drill machinery which rotates and pushes the drill head downward into the ground. These drills core rock such that, when the drill head is withdrawn, a barrel shaped core material is left within the bore hole, as the drill head just cut along a periphery thereof. This core material is awkward and cumbersome to remove, particularly in the case of wide diameter cores.

Current apparatus and methods for grabbing and withdrawing the cores often take several hours and are expensive. For example, chains or cables can slip off when lifting cores, causing the core to drop back in the hole. Suction methods are time consuming and unreliable, as they require creating a thick drilling mud to suction the core into the drill. Which can be additional problematic because using the drill to extract the core risks damage to the drill itself.

As can be seen, there is a need for an apparatus and method for extracting cores from drilled holes without using the drill itself. Specifically, an apparatus that provides peripheral fingers having wedges so that after the apparatus is lowered into the hole, raising the apparatus therefrom automatically securely grabs and thereby extracts the core, eliminating the chance of dropping the core back into the hole. Furthermore, utilizing a method that does not require the use of the drill further eliminates the possibility of damage to the drill and resulting delays to the project.

SUMMARY OF THE INVENTION

In one aspect of the present invention, a core extracting device provides a generally cylindrical outer casing; a plurality of tapers recessed in and spaced apart along a circumferential inner surface of the outer casing; and an inner grabber snugly slidable along said circumferential inner surface between a release condition and a gripping condition, the inner grabber providing: a spider plate; a plurality of fingers perpendicularly extending downward from a periphery of the spider plate; and a wedge provided along an outer surface of each finger of the plurality of fingers, wherein each wedge nests in a respective taper of the plurality of tapers in the release condition.

In another aspect of the present invention, the core extracting device provides a generally cylindrical outer casing extending from an upper end to an open lower end; a cap joined along the upper end, the cap having at least one latch slot; at least one cap connector hole; and at least one upwardly extending attachment plate; a plurality of tapers recessed in and spaced apart along a circumferential inner surface of the outer casing; an inner grabber snugly slidable along said circumferential inner surface between a release condition and a gripping condition, the inner grabber providing a spider plate, wherein the spider plate provides a plurality of radially extending spider arms from which a plurality of fingers perpendicularly extends downward from; at least one latch hook upwardly extending from the spider plate and through a respective latch slot of the at least one latch slot in the release condition; at least one plate connector hole provided in the spider plate; a wedge provided along an outer surface of each finger of the plurality of fingers, wherein each wedge nests in a respective taper of the plurality of tapers in the release condition, wherein the gipping condition the inner grabber protrudes from said lower end and each wedge is not nested in its respective taper of the plurality of tapers; a latch for each latch hook, wherein the latch is engageable with a respective latch hook of the at least one latch hook between an unlocked engagement and a locking engagement in the release condition; and at least connecter interconnecting a respective plate connector hole and a respective cap connector hole of the at least one plate and cap connector holes, respectively.

These and other features, aspects and advantages of the present invention will become better understood with reference to the following drawings, description and claims.

DETAILED DESCRIPTION OF THE INVENTION

Figure 1:
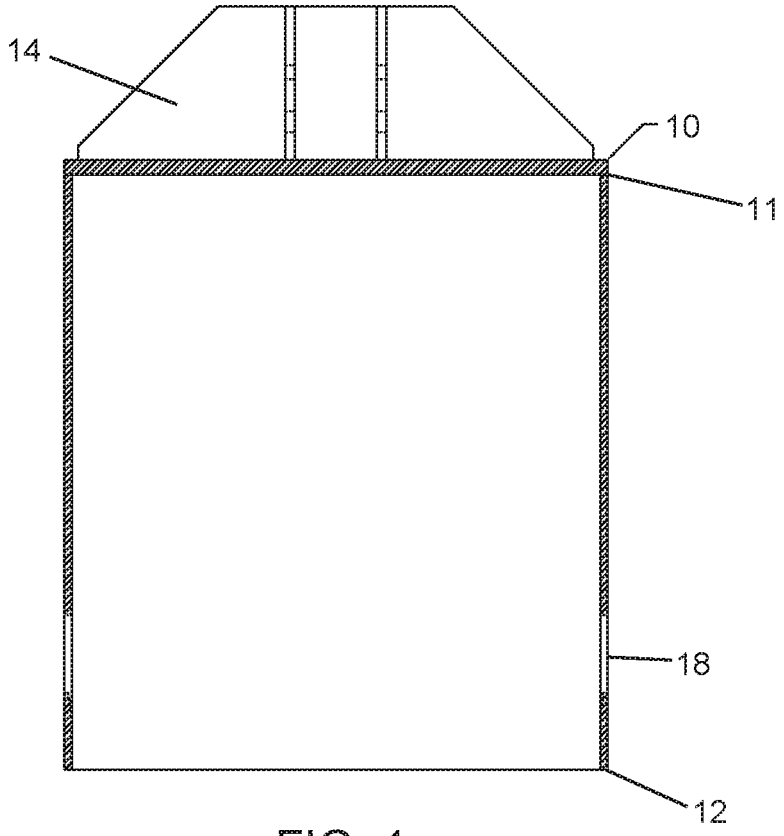
FIG. 1 is a section view of an exemplary embodiment of an outer casing of the present invention.
Figure 2:
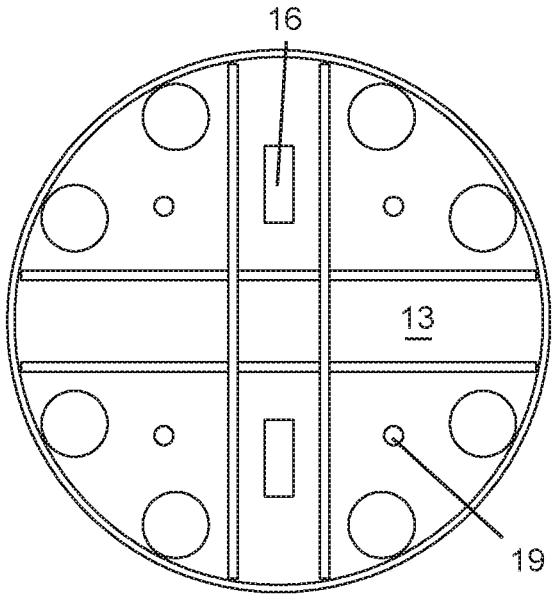
FIG. 2 is a top plan view of an exemplary embodiment of the outer casing of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an annular core extracting apparatus dimensioned to be lowered into the core groove circumscribing the drilled core. The core extracting apparatus has a cylindrical outer casing encasing a cylindrical inner grabber in a release condition, wherein the inner grabber is adapted to move from the release condition to a gripping condition when the outer casing is lifted from the core groove. The inner grabber provides a plurality of peripheral fingers, each finger providing a wedge along its outer surface, wherein the release condition each wedge nests in a taper provided by the outer casing so that when the inner grabber moves to the gripping condition the wedge interfaces with the outer casing to urge the fingers inward gripping the core and extracting it from the drilling hole.

Accordingly, it should be understood by those skilled in the art that the use of directional terms such as upper, lower, upward, downwardly, outer, inner and the like are used in relation to the illustrative embodiments as they are depicted in the figures, the upward direction (or upper) being toward the top of the corresponding figures and a downward direction being toward the bottom of the corresponding figure.

Referring to FIGS. 1 through 7, the present invention may include a core extracting apparatus 100. The core extracting apparatus 100 may provide an outer casing 10 encasing an inner grabber 20 in a release condition, the inner grabber 20 being movable between the release condition and a gripping condition wherein a distal end of the inner grabber 20 protrudes from an open lower end 12 of the outer casing 10.

The outer casing 10 having a cap 13 providing attachment plates 14. The outer casing 10 may be a cylinder extending from an upper end 11 to the lower end 12, wherein the cylinder is dimensioned and adapted to have approximately the same diameter as that of the drilling head used to create the grooves of the drilling cores. The cap 13, attached to the upper end 11, may be circular with a plurality of holes provided along and inward of its periphery, while providing a two spaced apart latch slots 16 generally disposed so as to mirror each other. Some of the holes may be cap connector holes 19. The attachment plates 14 may be flanges that extend upwardly from the cap 13 so that the core extracting apparatus 100 may be attached to a drill rig (not shown) or the other suitable lifting and lowering device. The outer casing 10 provides a plurality of spaced-apart tapers 18 recessed or formed into an inner circumferential surface of the outer casing 10 at a predetermined spacing. The plurality of spaced-apart tapers 18 may be disposed upward of the lower end 12, as illustrated in FIG. 1.

Figure 3:
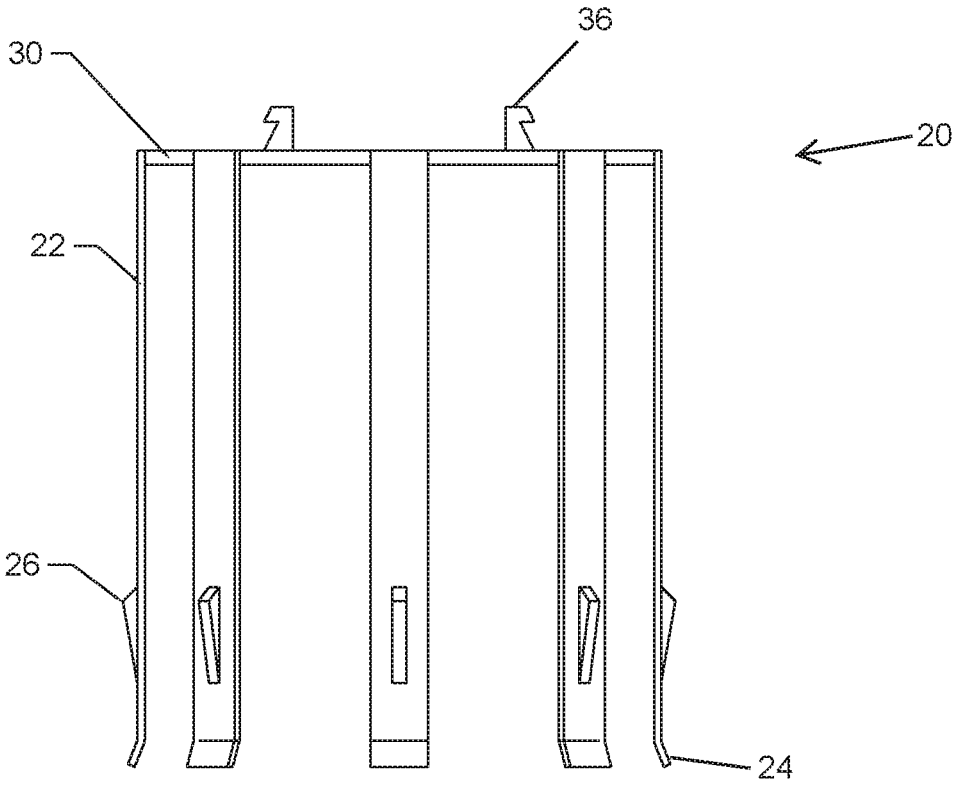
FIG. 3 is an elevational view of an exemplary embodiment of an inner grabber of the present invention.
Figure 4:
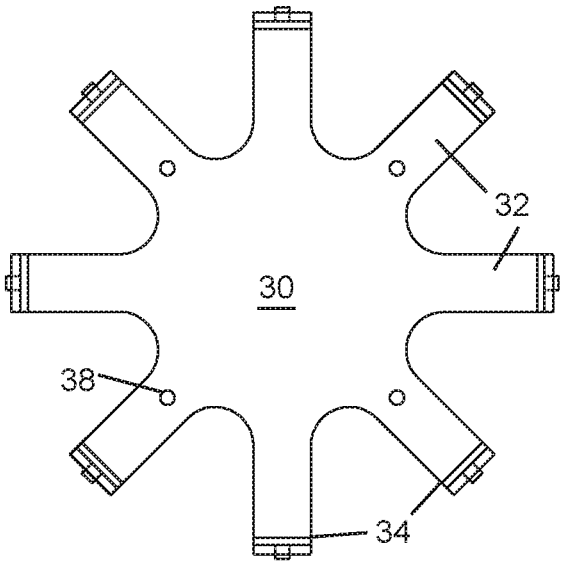
FIG. 4 is a top plan view of an exemplary embodiment of the inner grabber of the present invention.
Figure 5:
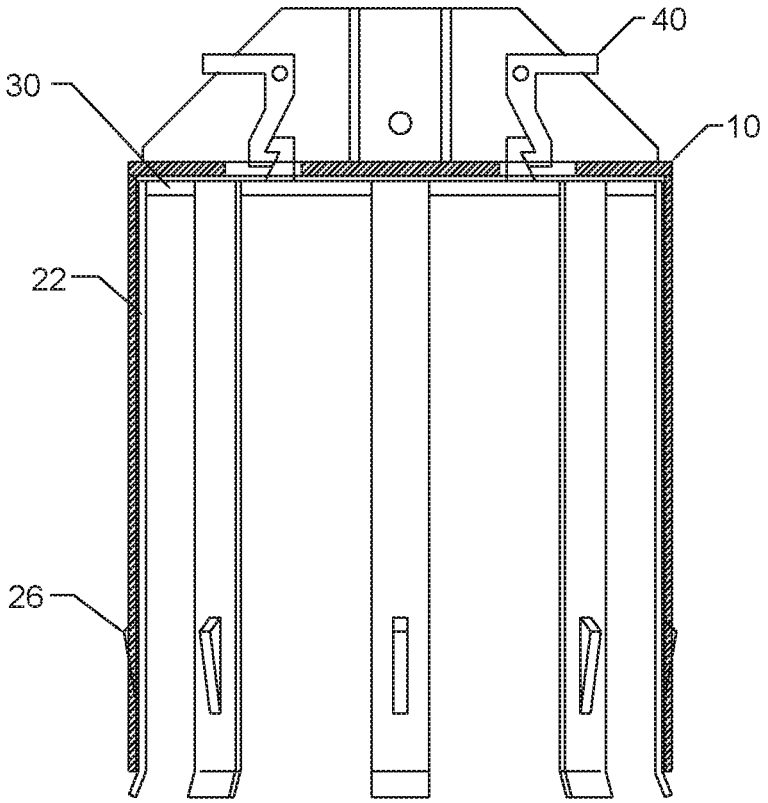
FIG. 5 is a section view of an exemplary embodiment of the outer casing showing an elevation view of the inner grabber of the present invention.
Figure 6:
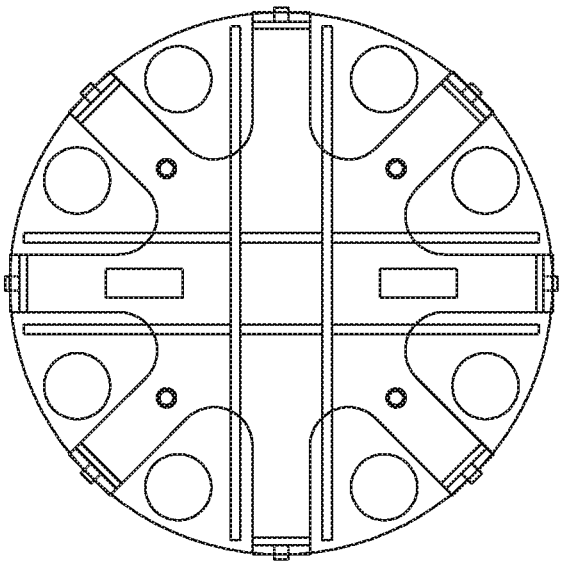
FIG. 6 is a top plan view of an exemplary embodiment of the present invention.
Figure 7:
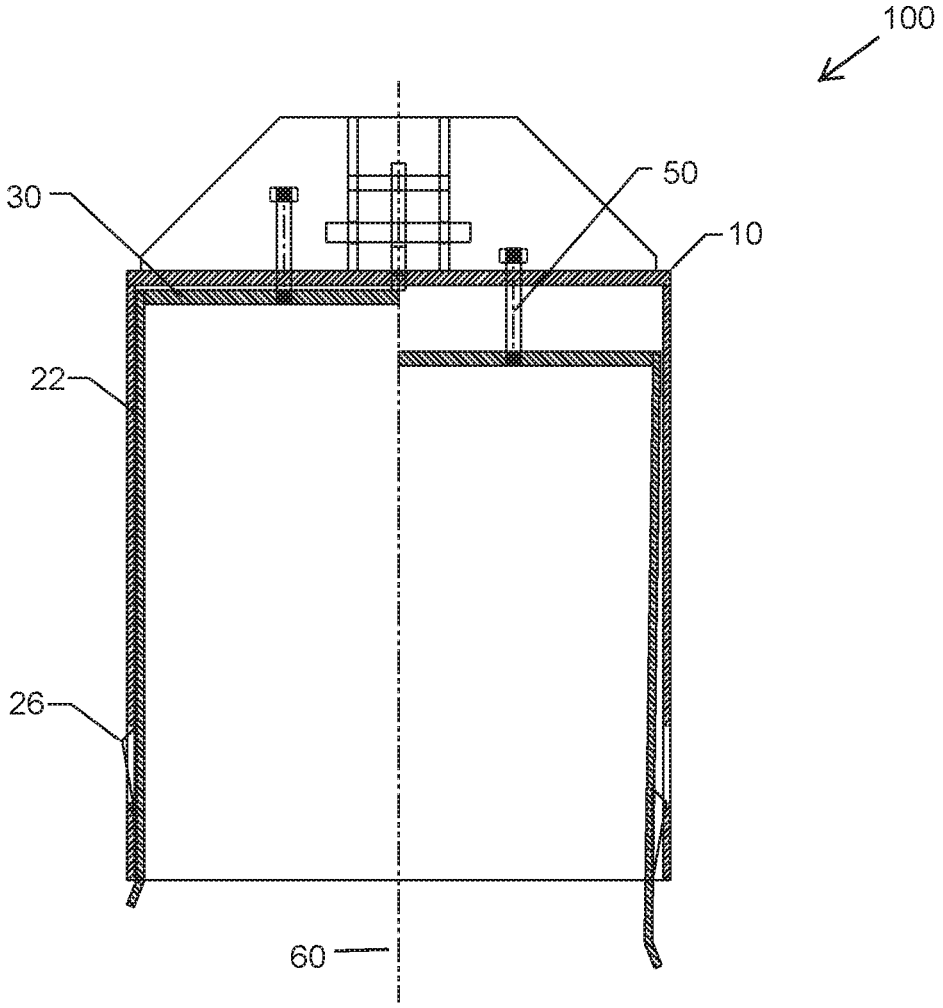
FIG. 7 is a section view of an exemplary embodiment of the present invention, wherein the left-hand side demonstrates a release condition and wherein the right-hand side demonstrates a gripping condition.

The inner grabber 20 includes a spider plate 30 providing a plurality of radially extending planar arms 32. The plurality of planar arms 32 are spaced-apart at the predetermined spacing of the above-mentioned tapers 18. From a distal end 34 of each arm 32 a finger 22 perpendicularly extends downwardly therefrom a distance approximately the same as a distance between the upper and lower ends 11 and 12 of the outer casing 10. Each finger 22 may terminate in an outward flaring flange 24, as illustrated in FIG. 3. A wedge 26 is provided along an outer surface of each finger 22 so that each wedge 26, when the inner grabber 20 is in the release condition, aligns and engages with or nests in its respective taper 18. When moving to the gripping condition, the fingers 22 are urged inward toward a longitudinal axis 60 (through a center of the outer casing 10) as the wedge 26 interfaces with the inner surface of the outer casing 10, as illustrated in FIG. 7.

The spider plate 30 may provide at least one latch hook 36 that upwardly extends therefrom so as to protrude through at least one of the two spaced apart latch slots 16 when the inner grabber 20 is in the release condition. The spider plate 30 may provide plate connector holes 38 therethrough.

A latch 40 may be provided for engaging each latch hook 36, wherein the latch 40 is adapted to form a locking engagement in the release condition, wherein the latch 40 is adapted so that it may be movable between the locking engagement and an unlocked engagement so that the inner grabber 20 may move to its gripping condition.

Connectors 50 may interconnect the cap 13 and the spider plate 30 so that the movement of the inner grabber 20 to the gripping condition may be limited so the inner grabber 20 does not over-slide or slide out of the outer casing 10. In certain embodiments, the connectors 50 may be tension rods engaging the plate connector holes 38 and the cap connector holes 19.

The core extracting apparatus 100 may be made of material that can be repeatedly withstand the forces envisioned herein without fracturing, such as various metallic materials, wherein components may be joined by welding or other suitable joining methods.

A method of using the present invention may include the following. The core extracting apparatus 100 disclosed above may be provided. The core extracting apparatus 100 are designed for easy mounting, via its attachment plates 14, on conventional drilling rigs or other lift machinery for raising and lowering of the core extracting apparatus 100. Then the outer casing 10, being annularly sized to approximate the associated drill head, may be lowered into the core groove snugly around the drilled core. Then a user may move the latches 40 to the unlocked engagement. Then the core extracting apparatus 100 is lifted, and as the outer casing 10 is raised the inner fingers 22 pull down due to friction with the core, which in turn urges the wedges 26 to interact with their respective tapers 18 and/or an inner surface of the outer casing 10, thereby causing the inner fingers 22 to squeeze inward and tighten against the core. The core is raised to be placed on a supporting surface so that the outer casing 10 lowers onto the inner fingers 22 in the release condition. Then the user may position the latches 40 to the locking engagement so that the core extracting apparatus 100 can be lifted in the release condition without the inner fingers 22 gripping the core, leaving the core behind on the supporting surface.

It should be understood, of course, that the foregoing relates to exemplary embodiments of the invention and that modifications may be made without departing from the spirit and scope of the invention as set forth in the following claims.

What is claimed is:

1. A core extracting device, comprising:

a generally cylindrical outer casing;

a plurality of cutouts through the outer casing and spaced apart along a circumferential inner surface of the outer casing; and an inner grabber snugly slidable along said circumferential inner surface between a release condition and a gripping condition engaging the core, the inner grabber comprising:

a spider plate;

a plurality of fingers perpendicularly extending downward from a periphery of the spider plate; and a wedge provided along an outer surface of each finger of the plurality of fingers, wherein each wedge nests in a respective cutout of the plurality of cutouts in the release condition.

2. The core extracting device of claim 1, wherein the spider plate provides a plurality of radially extending spider arms from which the plurality of fingers perpendicularly extends downward from.

3. The core extracting device of claim 1, wherein the outer casing extends from an upper end to an open lower end; and further providing a cap joined along the upper end, wherein the gipping condition the inner grabber protrudes from said lower end.

4. The core extracting device of claim 3, further comprising at least one latch hook upwardly extending from the spider plate; at least one latch slot formed in the cap, wherein the at least one latch hook protrudes through the at least one latch slot in the release condition; and further comprising a latch for each latch hook, wherein the latch is engageable with a respective latch hook of the at least one latch hook between an unlocked engagement and a locking engagement in the release condition.

5. The core extracting device of claim 3, further comprising attachment plates extending upwardly from the cap.

6. The core extracting device of claim 1, further comprising at least one plate connector hole provided in the spider plate; at least one cap connector hole provided in the cap; and at least connecter interconnecting a respective plate connector hole and a respective cap connector hole of the at least one plate and cap connector holes, respectively.

7. The core extracting device of claim 1, wherein the gripping condition, each wedge is not nested in its respective cutout of the plurality of cutouts.

8. A core extracting device, comprising:

a generally cylindrical outer casing extending from an upper end to an open lower end;

a cap joined along the upper end, the cap comprising:

at least one latch slot;

at least one cap connector hole; and at least one upwardly extending attachment plate;

a plurality of cutouts through the outer casing and spaced apart along a circumferential inner surface of the outer casing; and an inner grabber snugly slidable along said circumferential inner surface between a release condition and a gripping condition engaging the core, the inner grabber comprising:

a spider plate, wherein the spider plate provides a plurality of radially extending spider arms from which a plurality of fingers perpendicularly extends downward from;

at least one latch hook upwardly extending from the spider plate and through a respective latch slot of the at least one latch slot in the release condition;

at least one plate connector hole provided in the spider plate;

a wedge provided along an outer surface of each finger of the plurality of fingers, wherein each wedge nests in a respective cutout of the plurality of cutouts in the release condition, wherein the gipping condition the inner grabber protrudes from said lower end and each wedge is not nested in its respective cutout of the plurality of cutouts;

a latch for each latch hook, wherein the latch is engageable with a respective latch hook of the at least one latch hook between an unlocked engagement and a locking engagement in the release condition; and at least connecter interconnecting a respective plate connector hole and a respective cap connector hole of the at least one plate and cap connector holes, respectively.

* * * * *